US005845478A

United States Patent [19]

Ripley

[11] Patent Number: 5,845,478

[45] Date of Patent: Dec. 8, 1998

[54] LENS TOP SHELL

[75] Inventor: Richard E. Ripley, Attleboro, Mass.

[73] Assignee: Textron, Inc., Providence, R.I.

[21] Appl. No.: 927,749

[22] Filed: Sep. 11, 1997

Related U.S. Application Data

[63] Continuation-in-part of Ser. No. 714,022, Sep. 11, 1996.

[51] Int. Cl.[6] ..... F16G 13/00

[52] U.S. Cl. ..... 59/79.3; 63/5.1

[58] Field of Search ..... 59/78, 80, 82, 59/79.1, 79.3; 63/5.1

[56] References Cited

U.S. PATENT DOCUMENTS

| | | |
|---|---|---|
| 2,283,015 | 1/1942 | Reilly . |
| 2,805,541 | 10/1957 | Vastano . |
| 2,889,681 | 6/1959 | Augenstein . |
| 3,344,599 | 10/1967 | Hauser . |
| 3,416,305 | 12/1968 | Rieth . |
| 3,494,123 | 2/1970 | Kremer . |
| 3,587,226 | 6/1971 | Rieth . |
| 3,590,576 | 7/1971 | Rubinelli . |
| 3,625,001 | 12/1971 | Levinger . |
| 3,786,629 | 1/1974 | Rieth . |
| 3,844,136 | 10/1974 | Rieth et al. . |
| 3,994,126 | 11/1976 | Rieth . |
| 4,706,857 | 11/1987 | Aellen et al. . |
| 4,723,406 | 2/1988 | Ripley . |
| 4,763,489 | 8/1988 | Strong . |
| 4,958,334 | 9/1990 | Grosjean . |
| 5,441,686 | 8/1995 | Jackl et al. . |

FOREIGN PATENT DOCUMENTS

| | | |
|---|---|---|
| 0 095 236 | 3/1983 | European Pat. Off. . |
| 167891-A1 | 1/1986 | European Pat. Off. . |
| 570 638 A1 | 7/1992 | European Pat. Off. . |
| 570638-A1 | 11/1993 | European Pat. Off. . |
| 2 324 470 | 9/1976 | France . |
| 2302829 | 10/1976 | France . |
| 2311336 | 1/1974 | Germany . |
| 52-26868 | 2/1977 | Japan . |
| 60-220889 | 11/1985 | Japan . |
| 2 262 897 | 12/1992 | United Kingdom . |

*Primary Examiner*—David Jones
*Attorney, Agent, or Firm*—Gottlieb, Rackman & Reisman, P.C.

[57] ABSTRACT

A top shell for use on a link of a flexible linkage, the top shell comprising a molded body having a top portion with a top surface and a bottom portion defining an underside. The underside includes a recess into which is disposed a decorative material that is visible from the top surface. The top portion defines a lens that refracts incident light on the top surface to the decorative material to form an image associated with the decorative material.

19 Claims, 4 Drawing Sheets

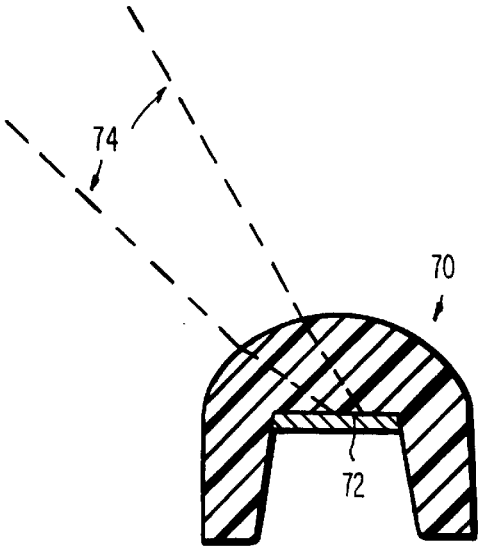
FIG. 11
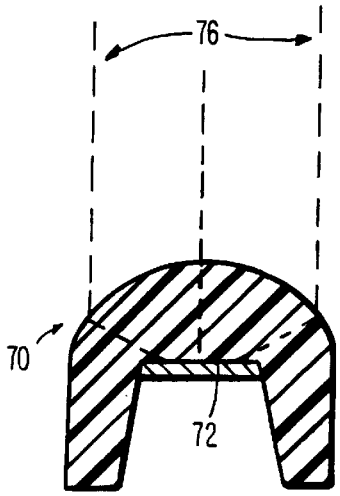
FIG. 12
FIG. 13
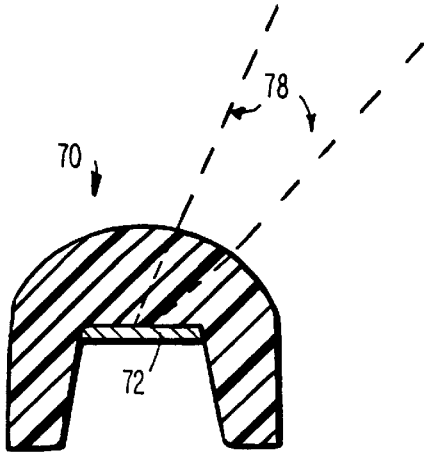
FIG. 14
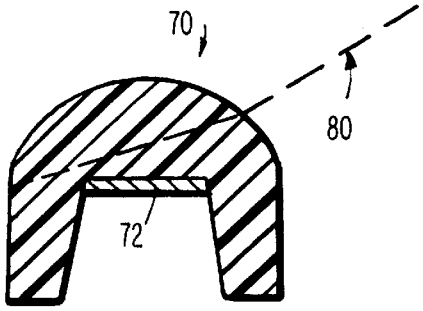

LENS TOP SHELL

This is a continuation-in-part of copending application U.S. Ser. No. 08/714,022 filed on Sep. 11, 1996.

BACKGROUND OF THE INVENTION

1. Field of the Invention

This invention relates generally to non-metallic transparent top shells which are provided on flexible linkages of the type employed in watchbands, and is concerned in particular with an improved top shell that includes a lens for forming an image associated with decorative material disposed within cavities on the undersides of such top shells.

2. Description of the Prior Art

The conventional expansible watchband typically includes a row of top links overlying a row of bottom links. The top links have hollow box-like configurations with open ends. Each bottom link is connected to two adjacent top links by pairs of U-shaped staples. Springs housed in the links coact with the staples to yieldably contract the band. The top and bottom links as well as the staples and springs are typically fabricated as metal stampings. Top shells, also typically fabricated as metal stampings, are applied to the top links to impart the desired ornamental appearance to the finished product.

Recent developments in expansible watchband technology have demonstrated the feasibility of substituting non-metallic top shells, in particular those molded of transparent plastic materials such as LEXAN polycarbonite resin and the like, for the conventional stamped metallic top shells. From the designer's standpoint, all plastic top shells open new windows of opportunity, including the introduction of vibrant colors and heretofore unachievable shapes, contours and images. An object of the present invention is to provide an improved top shell which enhances the ornamental effect of decorative material disposed within the underside cavities of transparent top shells.

It is a further object of the present invention to capitalize on the transparency of the transparent top shells by defining a lens in the top portion of the top shell that provides an enhanced and/or magnified image of decorative material disposed within the underside cavities of transparent top shells.

SUMMARY OF THE INVENTION

The present invention provides a top shell for use on a link of a flexible linkage, the top shell comprising a molded body having a top portion with a top surface and a bottom portion defining an underside. The underside includes a recess into which is disposed a decorative material that is visible from the top surface. The top portion defines a lens that refracts incident light on the top surface to form an image associated with the decorative material.

The present invention also provides that a plurality of adjacent top shells may be disposed on a flexible linkage, each top shell including an associated decorative image on its underside. When viewed from above, the top shells together form a composite image that is comprised of portions of each decorative image associated with each of the plurality of adjacent top shells.

BRIEF DESCRIPTION OF THE DRAWINGS

FIGS. 11–14 are cross-sectional views of an exemplary embodiment of a top shell diagrammatically showing the portion of the underlying image that is visible from a variety of angles.

DETAILED DESCRIPTION OF THE ILLUSTRATED EMBODIMENTS

Figure 1:
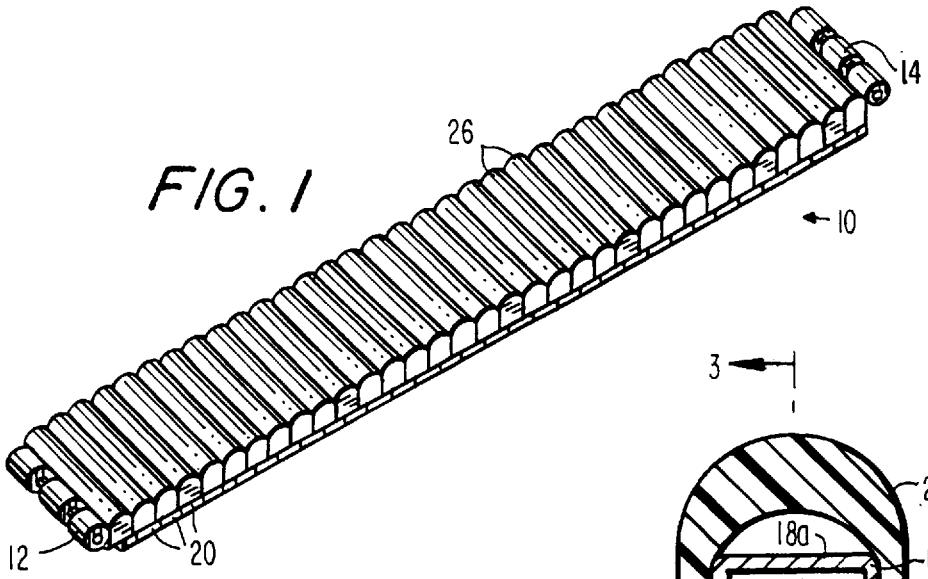
FIG. 1 is a perspective view showing an expansible watchband with plastic top shells molded and assembled in accordance with the present invention.
Figure 2:
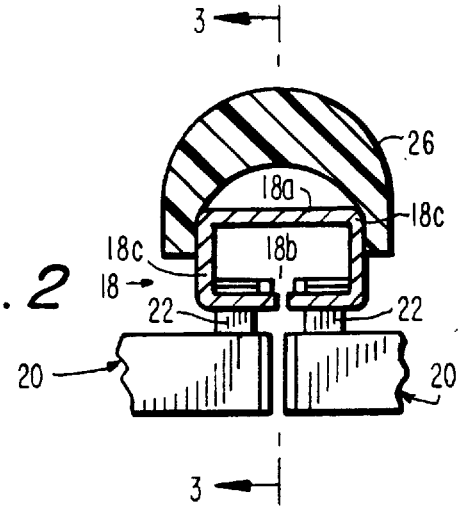
FIG. 2 is a sectional view on an enlarged scale taken along line 2—2 of FIG. 1.
Figure 4:
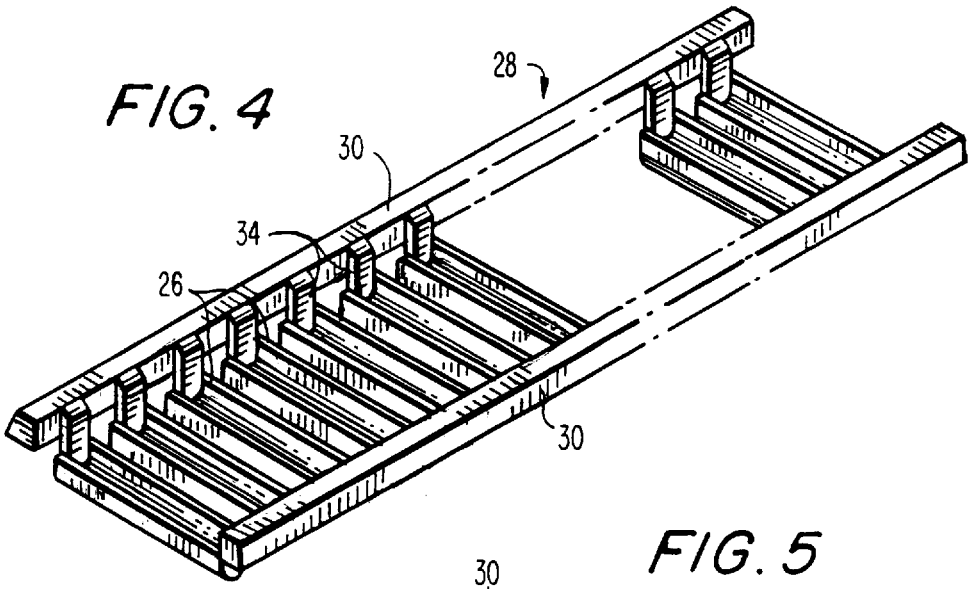
FIG. 4 is a perspective view of a molded framework of top shells in accordance with the present invention.
Figure 5:
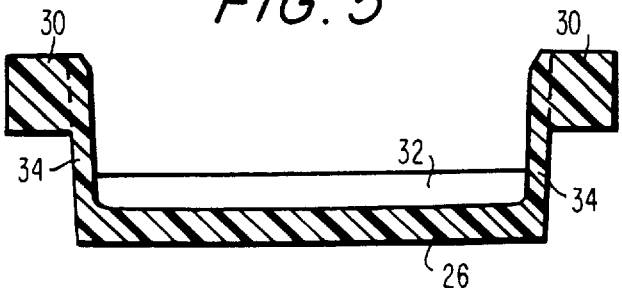
FIG. 5 is a sectional view on an enlarged scale taken along line 5—5 of FIG. 4.
Figure 6:
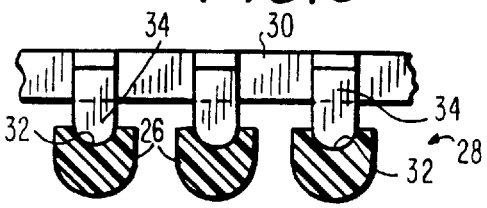
FIG. 6 is a sectional view taken along line 6—6 of FIG. 5.
Figure 3:
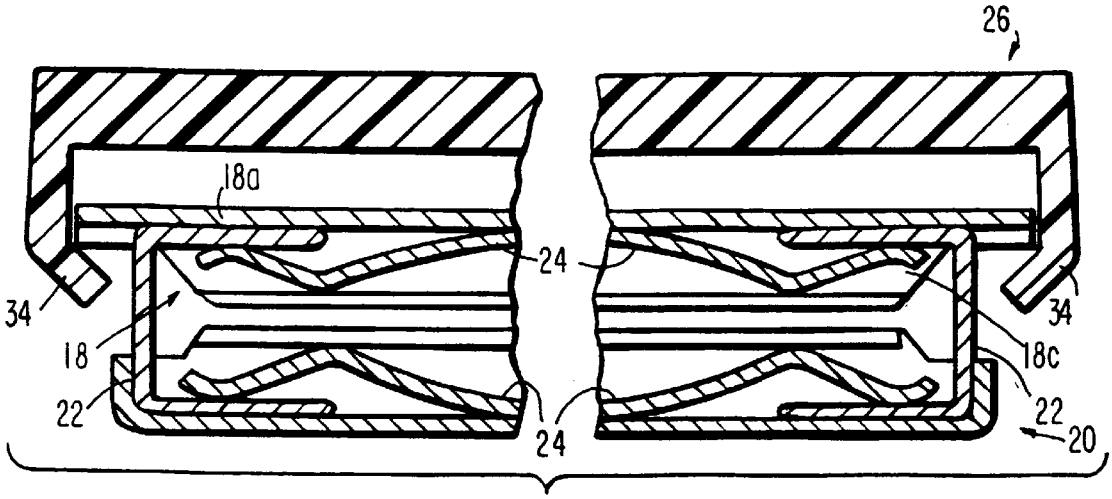
FIG. 3 is a sectional view taken along lines 3—3 of FIG. 2.
Figure 7:
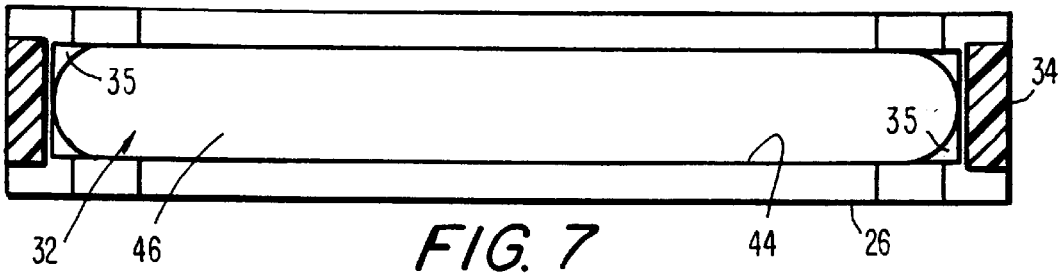
FIG. 7 is a sectional view taken along line 7—7 of FIG. 5.

Referring initially to FIGS. 1–3, an expansible linkage or flexible watchband 10 is shown with end connectors 12 and 14 designed to connect the watchband to a watch case (not shown). The watchband is of known construction, comprising a row of top links 18 overlying a row of bottom links 20. Each bottom link 20 is connected to two top links 18 by means of opposing pairs of U-shaped staples 22, the latter being acted upon by leaf springs 24 housed in the links. The leaf springs coact in resilient engagement with the staples to accommodate longitudinal expansion and contraction of the band in a manner well known to those skilled in the art.

The top links 18 have a hollow box-like configuration defined by top and bottom walls 18*a*, 18*b* and side walls 18*c*, with open ends extending laterally beyond the ends of the bottom links. The top links 18 are covered by transparent top shells 26. The top and bottom links 18, 20 and the staples 22 and springs 24 are all fabricated as metallic stampings, whereas the top shells 26 are molded entirely of a transparent plastic material.

With reference additionally to FIGS. 4–7, it will be seen that the top shells 26 are molded as integral parts of an elongated plastic framework 28. The framework includes two parallel side rails 30 with the top shells 26 extending transversally therebetween. The top shells are preferably molded with recesses or cavities 32 on their undersides, and with end tabs 34 integrally joining the top shells to the side rails 30. Flat or plateau areas 35 are provided on the underside adjacent the cavity. When assembled, the corners of the top link rests on the flat areas 35.

The framework 28 of top shells is ultimately applied to a bracelet linkage. For example, during assembly, a section of expansible watchband linkage is arranged between the side rails 30 of the framework 28, with the top links of the linkage aligned with the top shells 26 and extending between their respective end tabs 34. The end tabs are then severed from the side rails and simultaneously bent around and into mechanical interengagement with the ends of respective top links, thereby completing a simultaneous assembly of all of the top shells of the framework onto a like number of the top links of the watchband linkage.

Figure 8:
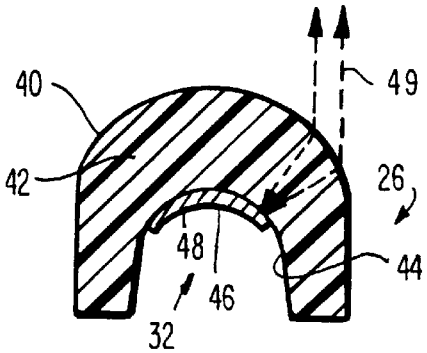
FIG. 8 is a cross-sectional view of an exemplary embodiment of a top shell in accordance with the present invention.
Figure 9:
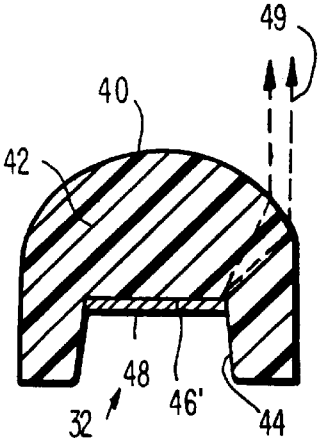
FIG. 9 is a cross-sectional view of another exemplary embodiment of a top shell in accordance with the present invention.

With reference now to FIGS. 8 and 9, it will be appreciated that the top shell 26 of the present invention has a top surface 40 that is rounded or domed so as to define a lens 42 within the top portion of the top shell. The cavity 32 includes sidewalls 44 and bottom surface 46. The bottom surface 46 is configured to be rounded or domed corresponding to the contour of top surface 40, or alternatively configured to be flat 46'.

In accordance with an exemplary embodiment of the present invention, decorative material 48, such as colored paint or ink or other decorative films, is deposited within the cavity 32. The decorative material is applied only to the bottom surface 46 of the cavity. Due to the transparent construction of the top shell, the decorative material is visible from the top surface 40. In yet another alternative embodiment, the decorative material is a deposit of fluorescent material which, for example, causes the top shell to glow in the dark.

The lens 42 serves to enhance and magnify the image of the decorative material viewed from the top surface 40. Incident light 49 to the top surface is refracted toward the decorative material to form the image associated therewith. For example, one imaging effect provided by the lens 42 is to make the decorative material appear to fill the entire top surface of the top shell. It will be noted that in exemplary embodiments, the cavity has a width that is slightly greater than half the width of the entire top shell. However, due to the refraction of incident light into the top surface by the lens, the decorative material appears to a viewer at the top surface to fill the entire top portion of the top shell.

In another exemplary embodiment, the decorative material is applied as thin stripes of red, blue and yellow ink or paint on the bottom surface of the cavity 32. The imaging effect provided by the lens 42 is such that a rainbow of colors appears at the top surface as the top shell is viewed from side to side.

Figure 10:
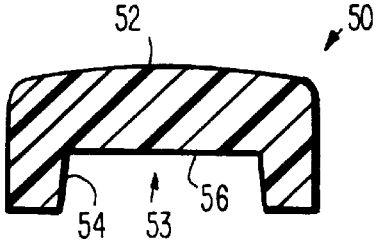
FIG. 10 (PRIOR ART)
FIG. 10 is a cross-sectional view of a conventional top shell.

The lens 42 provides visual effects which were previously unattainable with the conventional plastic top shells. In fact, less decorative material is required to be applied to the underside of the top shell of the present invention than that required by the conventional top shells for the same visual effect. FIG. 10 shows a cross-sectional view of a conventional plastic transparent top shell 50. Since this top shell does not have a lens, the image of any decorative material applied to the underside would not be enhanced or magnified. In other words, if the decorative material is applied only to the bottom surface 56 of the cavity 53, the image provided to the top surface 52 would not be such that the entire top portion of the top shell 50 is filled with the decorative material. In fact, as viewed from above, the areas adjacent to the cavity would appear vacant of the decorative material.

One of the advantages of the top shell 26 with lens 42 in accordance with the present invention is the appearance of the top shells when applied to the expansible linkage in a non-expanded state. Due to the enhanced or magnified image of the decorative material applied to the underside cavity, the boundaries between adjacent links and associated top shells blend in so as not to be noticeable. With the conventional top shells, the boundaries between adjacent links is well defined and in some instances unattractive.

As shown in FIG. 11, when viewed from one side, a top shell 70 of the invention including decorative material 72 produces an image associated with only a portion of the decorative material 72 when viewed from a range of directions generally around 45 degrees. The directional nature of the produced image is due to the curvature of the lens and the optical density (or index of refraction) of the material. In a preferred embodiment, the top shell has an outer curve defined by a radius of 0.055 inches, and is made from LEXAN polycarbonite resin which has an index of refraction of 1.586. Within the range of viewing angles generally indicated at 74, only a portion of the decorative material will be seen, but that portion will fill the lens 72 giving the appearance that the associated portion is very large.

As shown in FIG. 12, when viewed from directly above (as generally indicated at 76), the central portion of the decorative material 72 will appear to fill most of the top shell 70. This is again, due in part to the relatively high index of refraction of the LEXAN material, as well as the acute angle of incidence at the outer edges of the top shell lens. If the top shell were flat on top, the apparent image would be simply the decorative material itself to scale without magnification or distortion.

Similar to the embodiment shown in FIG. 11, the image appearing from the direction generally indicated at 78 is formed of only a portion of the decorative material 72, but the image fills the top shell 70 giving the appearance that the viewed portion is very large.

As shown in FIG. 14, when the angle of viewing becomes too shallow (as generally indicated below 80), then no portion of the decorative material 72 will be visible, and only the plastic top shell 70 itself will be seen.

Figure 15:
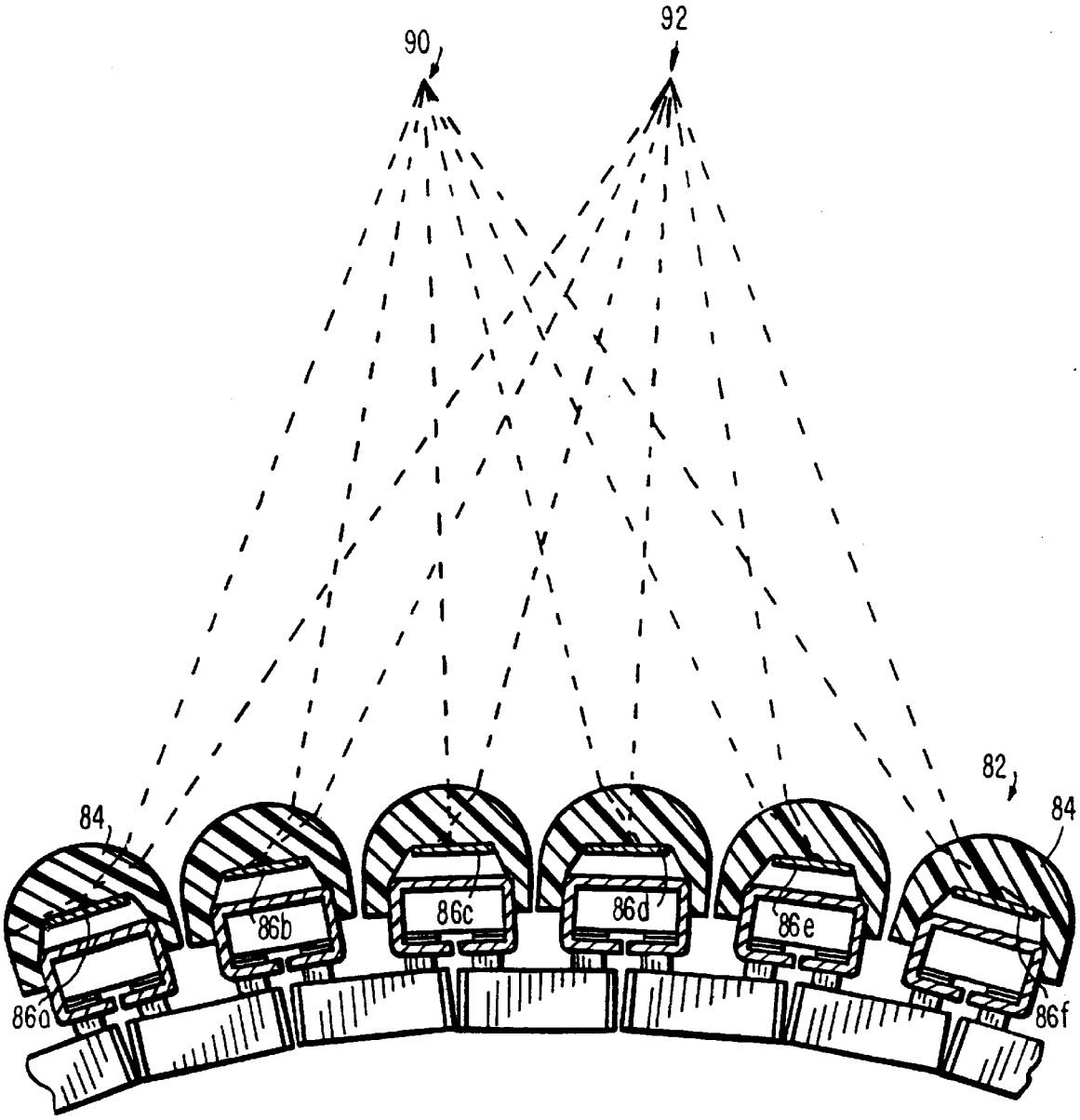
FIG. 15 is a cross-sectional view of a portion of an expansible watchband diagrammatically showing the portions of the underlying images that comprise the composite images when viewed from adjacent positions.

FIG. 15 shows a portion of an expansible watchband 82 with top shells 84 of the invention including decorative material 86. The watchband 82 is shown curved as if on a person's wrist. When viewed from a first position 90, the viewed image is comprised of portions of decorative materials 86*a*, 86*b*, 86*c*, 86*d* and 86*e*. When viewed from a second position 92, the viewed image is comprised of portions of decorative materials 86*b*, 86*c*, 86*d*, 86*e* and 86*f*.

Since successive images (90, 92 etc.) are comprised of successive sections of the decorative materials, apparent motion may be achieved by providing slightly varied decorative materials adjacent one another, much like a moving picture being comprised of successively varying frames. In this way, an image may appear to change as a person wearing a wristband of the invention rotates their arm. Such a watchband may be designed to give the appearance that an image (of for example a bug) is moving underneath the top shells as the wristband is rotated.

The image will also appear to be quite large, certainly larger than the size of an individual top shell. The composite image will appear to be larger than an individual top shell because the image is comprised of magnified portions of the underlying decorative materials, each portion generally appearing to fill an individual top shell. The magnification at angles that are not normal to each top shell, is enhanced by the fact that the wristband itself is curved. This further detracts from the unwanted appearance of the boundaries between adjacent links because an image may appear to move along the watchband underneath the top shells.

In order to ensure that the viewed composite image is not distorted, therefore, the decorative material must be condensed. In a preferred embodiment, the decorative material is condensed to one third its normal size in the direction along the length of the wristband.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. A top shell for use on a link of a flexible linkage, said top shell comprising a transparent molded body having a top portion with a top curved surface which is rounded or domed and a bottom portion including a bottom surface and a decorative material disposed on only a part of said bottom surface, said top portion, by virtue of said top curved surface thereof, constituting a lens that magnifies said decorative material so that said decorative material appears to cover the entire bottom surface of said bottom portion from at least one perspective of viewing from above said top surface of said top portion.

2. The top shell of claim 1, wherein said body is formed from a transparent plastic.

3. The top shell of claim 1, wherein said lens forms a magnified image of said decorative material within said cavity.

4. The top shell of claim 1, wherein said bottom surface includes a recess having sidewalls leading from bottom edges of said bottom surface to a recess surface, said recess surface being narrower in width than said top surface.

5. The top shell of claim 4, wherein said recess surface is flat.

6. The top shell of claim 4, wherein said recess surface is rounded or domed.

7. The top shell of claim 4, wherein said decorative material is provided only on said recess surface.

8. The top shell of claim 7, wherein said decorative material comprises a thin layer of colored paint or ink.

9. The top shell of claim 7, wherein said decorative material comprises thin strips of colored paint or ink.

10. The top shell of claim 7, wherein said decorative material comprises a fluorescent material.

11. A wristband including top shells disposed on links of a flexible linkage, said top shells each comprising a transparent molded body having a top portion with a top curved surface which is rounded or domed and a bottom portion including a bottom surface and a decorative material disposed on only a part of said bottom surface, said top portion, by virtue of said top curved surface thereof, constituting a lens that magnifies said decorative material, said top shells being arranged on said links to produce a composite image when viewed from at least one perspective above said top surface, said composite image being comprised of portions of said decorative material from adjacent top shells.

12. The wristband of claim 11, wherein each said composite image changes as said wristband is rotated in the direction of said wristband.

13. The wristband of claim 11, wherein said composite image appears to be larger than an individual top shell.

14. The wristband of claim 11, wherein said molded body is formed of a material having an index of refraction of at least 1.5.

15. The wristband of claim 11, wherein the appearance of said composite image is enhanced when said wristband is viewed in a curved position.

16. The wristband of claim 11, wherein each said bottom surface of each top shell includes a recess having sidewalls leading from bottom edges of said bottom surface to a recess surface, said recess surface being narrower in width than said top surface.

17. The wristband of claim 16, wherein said recess surface is flat.

18. A top shell assembly for use on a link of a flexible linkage, said top shell assembly comprising a transparent top shell and a decorative material underlying only a portion of said top shell, said top shell having a curved or round configuration thereby constituting a lens to magnify said decorative material.

19. A top shell assembly as claimed in claim 18, wherein said magnified decorative material appears to fill the entire top shell when viewed from above said top shell.

* * * * *